United States Patent [19]

Toews

[11] Patent Number: 4,861,304

[45] Date of Patent: Aug. 29, 1989

[54] THROWING TOY

[76] Inventor: Harvey R. Toews, Rt. 2, Box 271, MacPherson, Kans. 67460

[21] Appl. No.: 95,213

[22] Filed: Sep. 11, 1987

[51] Int. Cl.[4] ..... A63H 27/00

[52] U.S. Cl. ..... 446/34; 446/61; 273/426; D21/85

[58] Field of Search ..... 446/61, 45, 255, 34, 446/36, 46; 273/84 R, 67 R, 84 ES, 426, 428

[56] References Cited

U.S. PATENT DOCUMENTS

| | | | |
|---|---|---|---|
| 692,608 | 2/1902 | Bristow | 273/426 |
| 2,548,748 | 4/1951 | Stephan | 446/36 |
| 3,559,331 | 2/1971 | Eller | 446/34 |
| 4,079,936 | 3/1978 | Schachter | 273/67 R |
| 4,253,673 | 3/1981 | Bailey | 273/428 |
| 4,452,007 | 7/1984 | Martin | 446/45 |
| 4,522,398 | 6/1985 | Swartz et al. | 273/84 R |

*Primary Examiner*—Richard J. Johnson

*Attorney, Agent, or Firm*—Hovey, Williams, Timmons & Collins

[57] ABSTRACT

A lightweight, one piece throwing toy is disclosed which, when thrown, provides a unique pattern of flight. The toy is provided with a pair of wing sections joined together by a throwing section. Each wing section is constructed to be of similar length and cross-sectional dimensions. The cross section of each wing section is of greater width than depth. The grasping section is of a different and preferably smaller cross section than the wing sections, and is of a shorter length than either of the wing sections. The toy is thrown so that it remains parallel to the ground and rotates as it leaves a person's hand. The tumbling motions enable the toy to circle, lift or drop as it flies through the air, thereby permitting use either individually or with a partner.

8 Claims, 2 Drawing Sheets

FIG. 7.
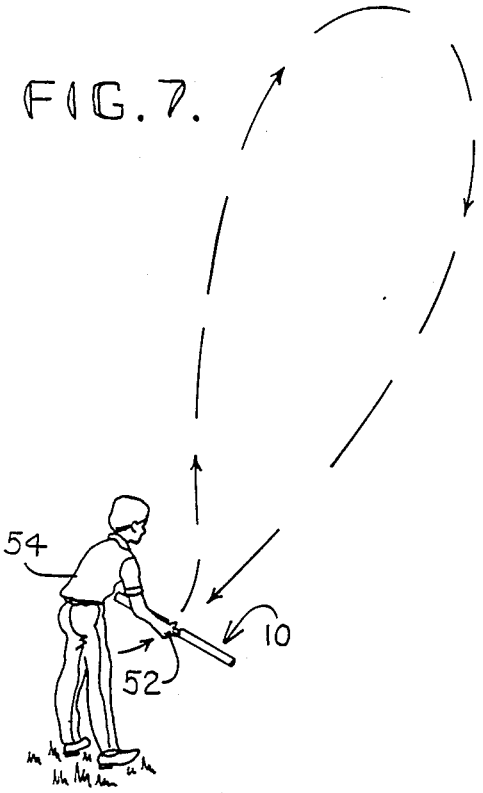
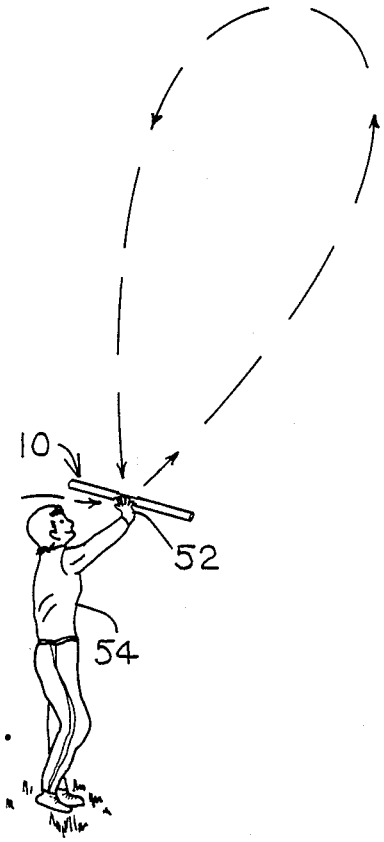
FIG. 6.
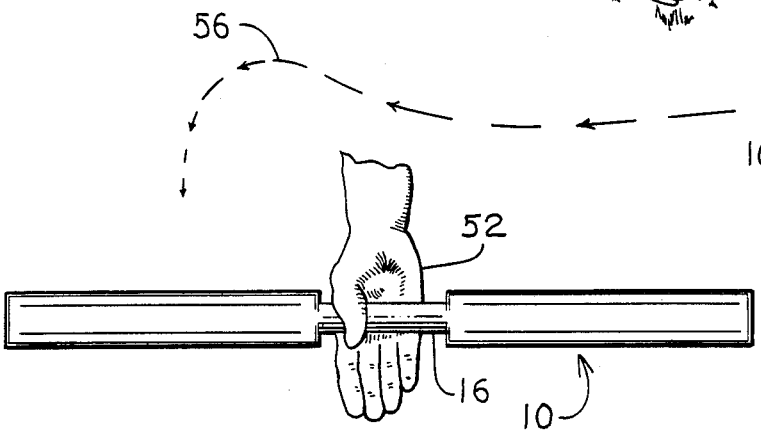
FIG. 5.
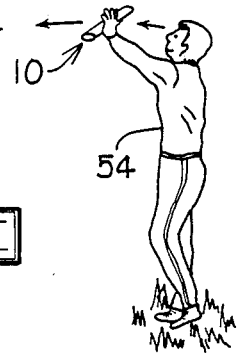
FIG. 8.

THROWING TOY

BACKGROUND OF THE INVENTION

1. Field of the Invention

This invention relates to an article adapted to be thrown as a toy. Particularly, it pertains to a lightweight throwing toy having two wing sections joined by a graspable intermediate throwing section. When the toy is spun around its longitudinal axis as it leaves the thrower's hand, it lifts or drops in a circular path in the direction of rotation.

2.2. Description of the Prior Art

A number of different throwing articles have been known throughout history. Such articles are used in various sports, as entertainment items or as weapons. Balls of various shapes and sizes are well known to the art. In addition, articles such as discs, rings, hoops and poles have long been thrown and enjoyed for the sake of amusement. One device which has always intrigued users is the Australian boomerang because of its unique characteristic of returning to the thrower. Unfortunately, the boomerang requires a great deal of space to use because it travels in a large, substantially circular path. As a result, its usefulness is largely limited to open outdoor areas. Also, the boomerang travels at a moderately high speed and may have sharp edges, making it difficult or even dangerous to catch.

SUMMARY OF THE INVENTION

The problems outlined above are in large measure solved by the present invention which provides a simple yet effective toy which is safe to use, travels at modest speeds, may be used individually or with a partner, may be used indoors, and yet still provides the amusement value of throwing toy tending to return to its point of origin.

Broadly speaking, the throwing toy of the invention includes a pair of elongated, lightweight wing surfaces joined together by a graspable throwing section. The throwing section is adapted to be held by a person's hand.

The wing sections are longer than the throwing section. Further, the throwing section is of a different, preferably smaller cross section than the wing sections. For ease of construction and proper flight performance, the radius of the throwing section is advantageously about one-half the thickness of the wing sections and about one-fourth or less of the width of the wing section. The throwing toy should be constructed without sharp edges. The leading and trailing wing edges are preferably rounded as are each of the corner surfaces. Further, the toy should be lightweight to enhance its flight characteristics and avoid injury to a person attempting to catch the toy. Accordingly, the toy is advantageously made of such materials as balsa wood, synthetic resins, rubber or styrofoam. The toy will preferably have an overall density in the range of five to twenty-five pounds per cubic foot.

Finally, the toy should be constructed to be substantially rigid in flight. While the surface of the toy may be deformable when it contacts a person or collides with an object, it should be sufficiently resilient to return to its original shape. Thus, the toy hereof, constructed of e.g. polyethylene plastic, should remain rigid in flight though it may deform slightly when caught, or when striking the floor.

The toy may be built of lightweight wood such as balsa, cedar or pine. Alternately, it may be molded of rubber or expanded rigid synthetic resin foam. Finally, it may be manufactured by extrusion, vacuum forming or various other manufacturing techniques for synthetic resins.

BRIEF DESCRIPTION OF THE DRAWING

FIG. 5 is a view showing the placement of the throwing toy in a person's hand;

FIG. 6 is a perspective view showing the flight path of the throwing toy hereof when thrown in a substantially vertical direction from an overhand position; and FIG. 7 is a perspective view showing the flight path of the throwing toy hereof when thrown from an underhand position.

FIG. 8 is a perspective view showing the flight path of the throwing toy hereof when thrown in a substantially horizontal direction from an overhand position.

DESCRIPTION OF THE PREFERRED EMBODIMENT

Figure 1:
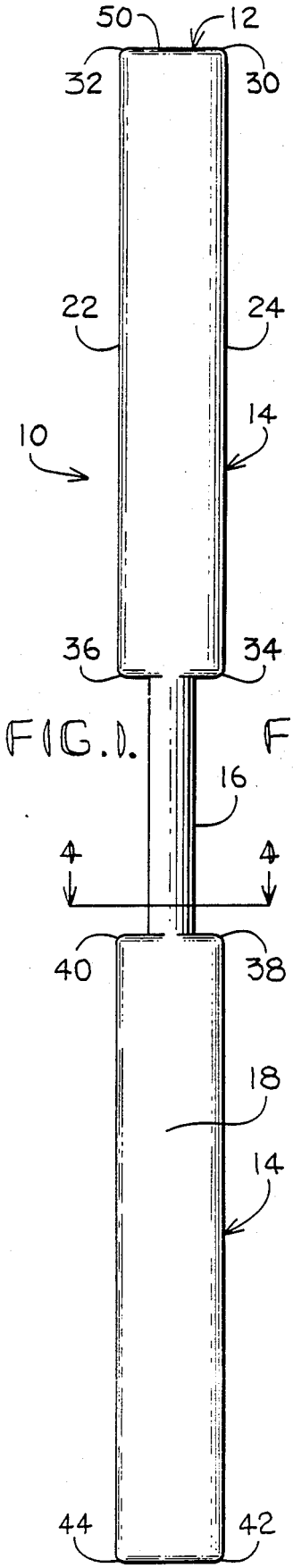
FIG. 1 is a front elevational view of the throwing toy in accordance with the present invention.

Referring now to the drawing, throwing toy 10 in accordance with the invention broadly includes elongated integral body 12 presenting a pair of elongated wing sections 14. Interconnecting the two wing sections 14 is a central graspable throwing section 16, which is of a different, and preferably smaller cross-sectional configuration than either of the two wing sections 14.

Figure 3:
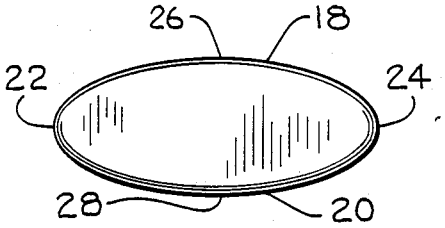
FIG. 3 is an end view of the throwing toy in accordance with the present invention.

Each wing section 14 is constructed to provide upper and lower surfaces 18, 20 of substantially identical configuration, and is provided with leading edge 22 and trailing edge 24 as shown in FIG. 3. The wing sections 14 also present a top point 26 and bottom point 28 on the respective surfaces 18, 20. The dimension between the leading 22 and trailing 24 edges is always greater than the dimension between the top point 26 and the bottom point 28 on the wing surfaces. To achieve proper flight characteristics, the distance between the top and bottom points preferably vary from about 15% to 60% of the distance between the leading and trailing edge and more preferably about 25% to 45%. In the illustrated embodiment, the wing sections 14 are in axial alignment; in other instances though, these wing sections may be nonaligned, i.e., with a pitch angle between the two wing sections.

Figure 2:
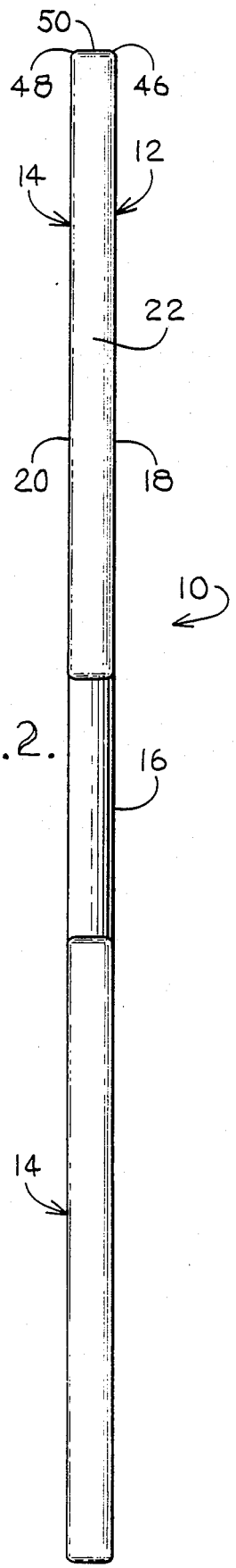
FIG. 2 is a side elevational view of the throwing toy in accordance with the present invention.
Figure 4:
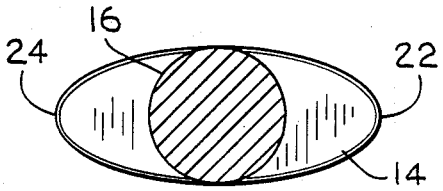
FIG. 4 is a sectional view along line 4—4 of FIG. 1 showing the relative cross-sectional areas of the throwing section and the wing sections.

Leading edge 22 and trailing edge 24 are preferably rounded to prevent injury to a user or damage from property arising from contact with the toy 10. Further, upper and lower surfaces 18, 20 are preferably smoothly arcuate to avoid any sharp edges and to provide a more effective airfoil. In particularly preferred forms, each wing section 14 is substantially elliptical in cross section as shown in FIGS. 3 and 4, with the distance between the leading and trailing edge being the major axis of the ellipse and the distance between the top and bottom points being the minor axis. Returning to FIGS. 1 and 2, each of the corners 30, 32, 34, 36, 38, 40, 42 and 44 are smoothed and rounded. Similarly, the margins 46, 48 between the end 50 and surfaces 18 and 20 are smoothed and rounded. The smoothing and rounding of all corners and edges minimizes any danger of injury during use. While the front view of surface 18 as defined by corners 38, 40, 42 and 44 is essentially rectangular in the preferred mode, end 50 may alternatively be more arcuate at the corners and yet function effectively.

Throwing section 16 interconnects wing sections 14 and is located midway between the wing sections. As may be seen in FIGS. 1, 2 and 4, throwing section 16 is preferably smaller in cross-section than wing sections 14 and is of an appropriate size to be grasped by a person's hand. Accordingly, the preferable circumference of the throwing section 16 will vary from 1.5 to 4.5 inches, and most preferably fall within the range of 2.25 to 3.15 inches. Similarly, the length of the throwing section 16 between throwing sections 14 need only be sufficient to be held by the thumb and two fingers as in a baseball pitch, or to lie comfortably within a person's hand 52 as shown in FIG. 5. Accordingly, the distance between corners 34, 36 and corners 38, 40 may vary between about 2 and 6 inches, and more preferably will be about 4 to 5 inches. Similarly, each wing section will vary in length from the same size as the throwing section 16 to virtually any length, but will preferably be from two to four times the length of the throwing section. The throwing section may be of any convenient cross-sectional configuration including circular or elliptical, or be provided with a plurality of grasping ridges or a textured grippable surface.

It is important for body 12 to be lightweight yet durable to withstand the impact of contact of the toy with the floor or other hard surface. Thus, while toy 10 may be made of such materials as expanded rigid foam, it is more advantageously constructed of balsa, pine, rubber or any of the suitable synthetic resin materials such as polyethylene, polyvinyl chloride or polyester.

When the weight of the toy remains light, the flight characteristics of the toy correspondingly improve although a toy of insufficient density will not travel a satisfactory distance when thrown. A toy in accordance with the present invention constructed of balsa wood, with two wind sections 12.75 inches long, 2.25 inches wide and a miximum 0.7 inch thickness, and a throwing section 5 inches long and 0.7 inch in diameter, weighs approximately 2.75 ounces. If constructed to the same dimensions of white pine, the toy would weigh approximately 8.75 ounces, and of hard rubber the would weigh about 25 ounces. The densities of the finished product (including voids) would thus be in the range of 3 to 75 pounds per cubic foot, with the best flying and durability characteristics achieved when the finished toy's density is 5 to 25 pounds per cubic foot.

The throwing toy 10 in accordance with the present invention may be of unitary construction or, alternatively, wing sections 14 may be manufactured separately and joined at the throwing section 16.

In use, the toy 10 may be thrown overhand or underhand as shown in FIGS. 5, 6 and 7. The toy is held in the hand 52 and thrown so that a spinning motion is imparted to the toy 10 as it leaves the thrower's hand 52. The toy 10 is thrown so that its longest dimension remains perpendicular to the path of flight and thus rotates about its longitudinal axis.

It may be appreciated that the direction of rotation will be counterclockwise when thrown from an overhead position and viewed from the right side of the thrower 54 as shown in FIG. 6. As the toy 10 tumbles when it leaves the fingertips of hand 52, the flight path of the toy follows the direction of rotation. Thus the toy 10 begins to move up and back toward the thrower 54 before returning to the thrower 54 assisted by the effects of gravity. When the toy 10 is thrown underhand, as shown in FIG. 7, the fingertips of the hand impart a clockwise spin to the toy as viewed from the thrower's right. When thrown vertically, the flight path of the toy 10 follows the direction of rotation moving initially down and away from the thrower 54 before the continued effects of rotation return the toy to the thrower.

When spun, the toy 10 travels in the direction of its rotation. As illustrated in FIG. 3, an airfoil is created as the leading edge 24 moves forward and rotates after the toy 10 leaves the thrower's hand 52. Absent any rotation, the two identical surfaces would cancel one another's lift. However, as the toy tumbles counterclockwise through the air, the upper surface 26 of the wing section 14 moves away from the onrushing air while the lower surface 28 moves toward the air, creating a relative low pressure area on surface 26. The surface 26 enjoying relatively lower air pressure than surface 28, positive lift is created in direction perpendicular to the path of flight causing the toy 10 to move in a counterclockwise direction as shown in FIG. 6. If the toy 10 is thrown underhanded, it spins in a clockwise direction. The upper surface 26 therefore always enjoys higher air pressure as trailing edge 22 moves in a clockwise direction and lower surface 28 enjoys lower air pressure. Because of the respective pressure differential, negative lift on the wing section 14 is thereby generated. Thus, the throwing toy 10 moves perpendicular to the path of the flight in a negative or clockwise direction. Obviously, the designation of which surface is the "upper" or "lower" surface will alternate as the toy 10 moves through the path of flight.

The toy 10 is therefore capable of different flight characteristics depending on the velocity, speed of rotation, and initial angle of attack. It is not limited to use by one person but may be thrown from one person to another in a game of catch.

FIG. 8 illustrates the flight path of the throwing toy 10 hereof when thrown in a substantially horizontal direction. Because it is thrown from an overhand position, the toy begins to rotate in a counterclockwise direction if viewed from the right side of the thrower 54, and thus the toy 10 begins to rise. The toy 10 begins to rise until it stalls and then makes little further horizontal progress as it drops to the ground. Thus, in a game of catch, the receiver can more advantageously catch toy 10 when it approaches stall point 56 because the horizontal progress slows at that point. The game may therefore entertain the participants not only by catching and throwing but by throwing the toy 10 at the appropriate velocity to match the stall point to the distance between the participants.

A variety of uses and variations in dimension, construction and material may be made of the invention disclosed herein.

I claim:

1. A throwing toy comprising: a pair of substantially identical, elongated wing sections, each of said wing sections being configurated to present a longitudinal axis, a pair of opposed, arcuate surfaces with said surfaces being substantially mirror images of one another about said longitudinal axis, and substantially eliptical cross-sectional having a greater width than depth; and manually graspable means respectively interconnecting said wing sections with said longitudinal axes thereof aligned with one another and with said graspable means in order to define a throwing axis for said toy for grasping and throwing said toy and for imparting rotation thereto about said throwing axis, said wing structures cooperatively presenting airfoil means for providing aerodynamic lift to said toy when thrown and rotated about said throwing axis and for enabling aerodynamic lift and return to a thrower of said toy in a generally vertical plane.

2. A throwing toy as set forth in claim 1, wherein said wing sections have leading and trailing edges; said edges having rounded surfaces.

3. A throwing toy as set forth in claim 2, wherein the upper and lower surfaces of said wing sections are arcuate in cross section.

4. A throwing toy as set forth in claim 3, wherein the cross section of the wing sections are essentially elliptical.

5. A throwing toy as set forth in claim 1, wherein the wing sections are in axial alignment.

6. A throwing toy as set forth in claim 1, wherein the graspable throwing section is circular in cross section.

7. A throwing toy as set forth in claim 1, wherein each wing section is substantially rectangular in plan.

8. The throwing toy as set forth in claim 1, said graspable means being elongated and presenting a long axis, said graspable means being located between said wing sections with said longitudinal axes thereof being aligned with said axis of said graspable means.

* * * * *